US005939661A

United States Patent [19]

Bayliss

[11] Patent Number: 5,939,661

[45] Date of Patent: Aug. 17, 1999

[54] METHOD OF MANUFACTURING AN EXPLOSIVE CARRIER MATERIAL, AND ARTICLES CONTAINING THE SAME

[75] Inventor: James Bayliss, Unionville, Conn.

[73] Assignee: The Ensign-Bickford Company, Simsbury, Conn.

[21] Appl. No.: 08/778,960

[22] Filed: Jan. 6, 1997

[51] Int. Cl.[6] ..... C06C 5/04; C06B 45/10; C06B 21/00

[52] U.S. Cl. ..... 102/289; 102/275.8; 102/275.11; 149/19.92; 149/93; 264/3.4

[58] Field of Search ..... 102/275.8, 275.11, 102/289; 149/19.92, 93; 264/3.4

[56] References Cited

U.S. PATENT DOCUMENTS

| | | | |
|---|---|---|---|
| 709,979 | 9/1902 | Garson . | |
| 871,696 | 11/1907 | Herr . | |
| 1,674,773 | 11/1928 | Fritzsche . | |
| 2,891,475 | 6/1959 | Dolan et al. | 102/275.8 |
| 3,698,316 | 10/1972 | Evans | 102/275.8 |
| 3,726,216 | 4/1973 | Calder, Jr. et al. | 102/275.8 |
| 3,860,677 | 1/1975 | Calder, Jr. | 102/275.1 |
| 3,945,320 | 3/1976 | Gibson et al. | 102/27 R |
| 3,995,525 | 12/1976 | Blair | 86/22 |
| 3,995,526 | 12/1976 | Shannon | 86/22 |
| 4,230,041 | 10/1980 | Bailey et al. | 102/275.8 |
| 4,232,606 | 11/1980 | Yunan | 102/27 R |
| 4,292,896 | 10/1981 | Morrey et al. | 102/275.8 |
| 4,312,272 | 1/1982 | Baker et al. | 102/275.8 |
| 5,267,513 | 12/1993 | Guirguis et al. | 102/475 |
| 5,518,807 | 5/1996 | Chan et al. | 428/305.5 |

FOREIGN PATENT DOCUMENTS

| | | |
|---|---|---|
| 0344098 | 11/1989 | European Pat. Off. . |
| 0367669 | 5/1990 | European Pat. Off. . |
| 167048 | 10/1904 | Germany . |
| 57-188491 | 11/1982 | Japan . |
| 59-46420 | 3/1984 | Japan . |
| 2054108 | 2/1981 | United Kingdom . |

OTHER PUBLICATIONS

S. Oinuma et al; A Thin Lead Azide Detonating . . . Type Explosion and Explosives; vol. 32, No. 6, 1971; pp. 27–35.

S. Oinuma; Lead Azide–Containing Sheet Initiator; Journal of The Industrial Explosives Society, Japan; vol. 35, No. 5, 1974 pp. 124–134.

*Primary Examiner*—Peter A. Nelson

*Attorney, Agent, or Firm*—Law Office of Victor E. Libert; Victor E. Libert; Roger C. Phillips

[57] ABSTRACT

An explosive particle-containing carrier material (24*b*) and a fully jacketed finished explosive material (33, 33') containing it, e.g., detonating cord, are produced in a high-speed continuous process by impregnating an absorbent carrier material such as cotton yarn (14) with a solution (12) of an explosive. Explosive particles (46) are precipitated from solution within the solution-impregnated carrier material (20) either by contacting the latter with a non-solvent fluid and/or subjecting it to flash evaporation under a vacuum. Rapid precipitation yields superfine explosive crystals (particles 46) within the carrier material (24*b*). Residual liquid non-solvent and/or solvent is removed from the carrier material, which may be encased in a plastic cover (38, 38') to provide a finished article (33, 33').

21 Claims, 1 Drawing Sheet

METHOD OF MANUFACTURING AN EXPLOSIVE CARRIER MATERIAL, AND ARTICLES CONTAINING THE SAME

BACKGROUND OF THE INVENTION

1. Field of the Invention

The present invention relates to an improved method of manufacturing explosive articles comprising detonating cord, sheet or shaped articles and, in particular, to a method for incorporating explosive material into such articles.

2. Related Art

Detonating cord is typically manufactured by one of three processes. In the wet process, particulate core material (i.e., pentaerythritol tetranitrate, "PETN") is mixed with water and other chemicals to provide a non-cap-sensitive slurry which is formed into a cylindrical rod about which a braiding machine braids yam or the like to form a cord of explosive having a cylindrical braided fabric casing around it. The slurry within the braided cord is then dried and, after the drying step, the braided cord is coated with plastic to provide additional strength and protection. The speed of a wet process manufacturing facility is limited by the length of time necessary to dry the slurry within the braided cord prior to application of the plastic coating. In the dry process, dry particulate core material (i.e., particulate PETN) is gravity-fed from a hopper into a plastic or paper tube as the tube is being formed from plastic or paper tape, over which a fabric sheath is helically spun. Dry process manufacturing requires frequent reloading of the PETN supply hopper with the explosive to provide a uniform core loading during the manufacturing process. In both the wet process and the dry process, the finished product comprises a core of explosive material surrounded by ajacket. In the extrusion process, which is disclosed in U.S. Pat. No. 4,232,606 issued on Nov. 11, 1980 and entitled "Explosive Connecting Cord", a billet of PETN is mixed with a plastic binding agent in order to provide an extrudable plastic-bonded PETN material having a viscosity comparable to that of modeling clay. The plastic-bonded PETN material is then extruded into a cord and a plastic jacket is applied over the extruded strand of PETN material. Optionally, strands of reinforcing yarn may be applied to the extruded PETN material and the plastic jacket applied thereover.

The publication Explosion and Explosives, is published by the Government Chemical Industrial Research Institute, Hirastsuka, Kanagawa, Japan. In Vol. 32, No. 6, 1971, at pages 27–35 of the published English language version, there appears an article by Senzo Oinuma, Masayoshi Kikkawa and Shohachiro Okubo entitled "A Thin Lead Azide Detonating Fuse Of Thread Type". This article (the "Oinuma et al article") discloses the fabrication of a lead azide detonating fuse by reacting lead nitrate and sodium azide within the weave of the fabric (thread) comprising the body of the fuse. The fuse is fabricated by boiling a cotton or linen thread in water to drive out any air, then immersing it in an aqueous solution of concentrated lead nitrate. The impregnated thread is then immersed in ethanol to precipitate the lead nitrate largely within the fibers of the thread, with some surface crystals being formed. The latter are shaken off the surface of the thread. Finally, the thread is immersed in a sodium azide solution to react the sodium azide with the lead nitrate within the thread for 1 to 2 hours to form small lead azide crystals within the weave of the thread. The formation of large lead azide crystals on the surface of the fabric is said to be prevented by shaking the lead nitrate crystals off the surface of the thread as described above, before the thread is immersed in the sodium azide solution. The finished product may be wrapped in cellophane tape to prevent spilling of the lead azide during handling.

The publication *Journal of the Industrial Explosives Society, Japan* contains, in Volume 35, No. 5, 1974, at pages 220–226, an article by S. Oinuma entitled "Lead Azide-Containing Sheet Initiator". This article ("the Oinuma article") discloses a method of preparing lead azide sheet-like material by treating a molded resinous sheet containing lead acetate with an aqueous solution of sodium azide. The raw material sheet is obtained by molding lead acetate powder with a binder and osmosis-promoters in an acetone solution. The acetone is evaporated from the solution in a pan to provide the raw sheet material. The authors point out that the technique of impregnating fibers with a lead nitrate solution (as discussed in the above-noted Oinuma et al article in *Explosion and Explosives*) does not work with the resinous sheet material because the sodium azide does not penetrate through the resinous sheet material. Consequently, lead acetate powder is molded within the sheet as described above. The raw material sheet is soaked in an aqueous solution of sodium azide, washed with water and dried. A concentrated rather than a dilute aqueous solution of sodium is used for the impregnation of the raw material sheet because the dilute solutions tend to form the lead azide on the surface of the sheet rather than within it.

Japanese Patent Document J 57-188 491 describes the manufacture of a pyrotechnic fuse by the impregnation of synthetic (nylon, polyester, acrylic, etc.) or natural (cotton, jute, etc.) fiber yarn with a pyrotechnic paste composition comprising a solvent mixed with nitrocellulose, a flame colorant and a fireworks powder.

U.S. Pat. No. 5,518,807 of Chan et al discloses depositing upon a porous substrate of oxidizing polymeric film, such as polytetrafluoroethylene ("PTFE"), an oxidizable material such as a metal or alloy selected from one or more of lithium, sodium, magnesium, beryllium, etc. The polymer, which is porous so that the metal may be deposited within the pores to promote intimate admixture and rapid reaction, and the metal conjointly react to exothermically generate energy for use, e.g., in inflating an air bag. (Column 1, lines 40–46.) In one embodiment, the deposited metal reactant is supplemented with an incendiary material such as sodium azide, which is also deposited within the pores of the polymer. See column 1, line 66, through column 2, line 4. In Example 2 (column 4), the addition of sodium azide is exemplified by soaking the porous PTFE film in a saturated aqueous solution of sodium azide and drying it to fill 50% of the available 90% pore space with solid sodium azide, leaving 40% of the pore space available to receive the metal. The result of addition of the incendiary material is said to be enhanced reaction speed and energy output.

SUMMARY OF THE INVENTION

In accordance with the present invention there is provided a method of manufacturing an explosive carrier material comprising the following steps. An explosive, such as an organic nitrate explosive, is dissolved in a solvent such as an organic solvent, to provide a solution. An absorbent carrier material impregnated with the solution to provide a solution-impregnated carrier material and explosive particles are precipitated within the solution-impregnated carrier material from the solution contained therewithin by removing at least some of the solvent from the solution-impregnated carrier material to yield an explosive particle-impregnated carrier material.

One aspect of the present invention provides for precipitating the explosive articles rapidly enough to form the explosive particles with a size distribution of at least about 99 percent by number of the particles having a diameter not greater han about 44 microns, and at least about 50 percent by number of the particles having a diameter not greater than about 5 microns.

Another aspect of the present invention provides for precipitating the explosive by introducing a non-solvent fluid, e.g., steam or water in liquid form, into the solution-impregnated carrier material. In one embodiment, this comprises flooding the solution-impregnated carrier material with a non-solvent liquid.

Yet another aspect of the present invention provides for precipitating the explosive particles by evaporating the solvent from the solution-impregnated carrier material, for example, by subjecting the solution-impregnated carrier material to a vacuum and/or by heating the solution-impregnated carrier material and subjecting the heated carrier material to the vacuum.

The present invention also provides for applying a jacket about the explosive particle-impregnated carrier material.

In accordance with the present invention there is also provided an explosive-containing particle comprising the following components. An absorbent carrier material has particles of explosive material dispersed therethrough and is obtained by impregnating the carrier material with a solution of an explosive dissolved in a solvent to provide a solution-impregnated carrier material, and then precipitating particles of the explosive within the impregnated carrier material from the solution contained therein. The explosive-containing article may be made by any of the methods described above.

DETAILED DESCRIPTION OF THE INVENTION AND PREFERRED EMBODIMENTS THEREOF

Figure 3A:
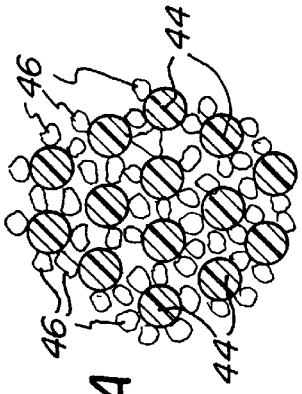
FIG. 3A is a view, enlarged with respect to FIG. 3, of the exposed end of the carrier material indicated at E in FIG. 3.

In practicing the present invention, an explosive such as an organo-nitrate explosive composition is dissolved in a suitable solvent and the resulting solution is impregnated into an absorbent carrier material such as a cord, string, ribbon, web or batt made of natural or synthetic fibers or a combination of natural and synthetic fibers, or of an open-cell, foamed plastic material, or sponge, or the like. As used herein and in the claims, the term "absorbent" used with respect to the carrier material means that the carrier material is capable of being impregnated by the solution and of retaining the solutions therein at least long enough for crystals of the dissolved explosive to be precipitated within and retained within the carrier material.

Generally, any suitable absorbent material may be employed, such as wool, cotton or polymeric materials, or blends of two or more thereof. The absorbent material may be in any suitable form, such as woven or non-woven cloth, batting, string, cord or fibers or combinations of any two or more thereof. In any case, the absorbent material is itself normally not a reactive material, but merely serves as a carrier for a reactive explosive material dispersed thereon in fine, crystalline form. Upon ignition, the explosive particles react and the absorbent material, or parts thereof, may be consumed in the resulting explosion, but the absorbent material may be, and usually is, inert in the sense that it need not be a material which is chemically reactive with the explosive particles dispersed therein.

After it is impregnated into the absorbent carrier material, the explosive composition is then precipitated out of the impregnating solution within the carrier material to leave particles of precipitated explosive composition dispersed throughout the carrier material. Any suitable explosive and any suitable solvent may be employed. For example, by way of illustration and not limitation, the explosive may be a nitrated organic explosive such as pentaerythritol tetranitrate ("PETN"), cyclotetramethylene tetranitramine ("HMX") or cyclo-1,3,5-trimethylene-2,4,6 trinitramine ("RDX"), and the solvent may be an organic solvent such as acetone or cyclohexanone.

After the solution of the explosive in the solvent is impregnated into the absorbent carrier material, the explosive composition is then precipitated out of the impregnating solution within the carrier material to leave particles of precipitated explosive composition impregnated throughout the carrier material.

The step of precipitating the explosive material within the carrier may be carried out by any appropriate means. For example, precipitation may be effectuated by rapidly evaporating the solvent from the impregnated carrier material and thereby precipitating the explosive which had been dissolved in the solvent. Evaporation of the solvent is advantageously carried out under a vacuum to attain flash evaporation. The carrier material may also be heated to an elevated temperature to facilitate rapid evaporation of the solvent. Alternatively, precipitation of the explosive within the carrier material may be carried out by rapidly introducing a non-solvent fluid, such as steam or liquid water, into the solution-impregnated carrier material. This may be carried out by injecting steam into the solution-impregnated carrier material or by flooding the solution-impregnated carrier material with water as by introducing the carrier material into a liquid non-solvent bath, typically a water bath, preferably a cold water bath. Introduction of a non-solvent fluid causes precipitation of dissolved explosive material within the carrier, because of the insolubility of the explosive material in the non-solvent fluid, e.g., a non-solvent liquid. If any solvent or non-solvent liquid remains in the impregnated material after such precipitation occurs, it may be removed, for example, at an evaporation or drying station.

In a preferred embodiment, the precipitation is performed rapidly, e.g., by immersing the solution-impregnated carrier in a non-solvent, e.g., water, bath or by flash evaporation of the solvent in a high vacuum chamber. Rapid precipitation results in production of superfine particles of explosive disposed uniformly throughout the absorbent material, for example, particles having a size distribution of at least 97 percent by number of the particles being not more than 44 microns in diameter, and at least 20 percent by number of the particles being not more than 5 microns in diameter.

A confining jacket, which facilitates detonation of the particle-impregnated carrier, may be applied to the explosive-impregnated carrier material to yield a finished article. The jacket may also be made liquid-impermeable to serve to improve the durability of the article by providing a barrier to entry into the carrier material of environmental elements such as water, oil and the like, and by providing improved abrasion resistance, and mechanical, e.g., tensile, strength.

Optionally, reinforcing means such as high-strength fibers can be incorporated into the article in addition to, or as part of, the confining jacket to enhance the tensile strength or other physical characteristics of the finished article.

When the present invention is used to manufacture detonating cord, the product differs from that obtained by the above-described conventional wet and dry processes. The latter processes result in a cord having a solid or granular packed column of explosive at the center of the cord. The present invention provides a core of absorbent material defining a matrix within which fine explosive particles are dispersed. The present invention differs from the processes described in the Oinuma et al and Oinuma articles mentioned above, in that the present invention precipitates within the carrier material explosive particles from a solution of the explosive in a solvent whereas the methods described in the articles react chemical precursors to form particles of the explosives within (and, undesirably, on the surface of) the carrier material by a chemical reaction. The Oinuma and Oinuma et al articles thus disclose the preparation of lead azide, a primary explosive, either by reaction within the carrier material of two precursor salt solutions or a precursor powder and precursor salt solution. The process of the present invention avoids the need for multiple impregnations of the absorbent carrier material and for protracted chemical reaction periods (e.g., 1 to 2 hours as in the Oinuma et al article) during which time the explosive precursors provided by the salt solutions react to form the explosive.

EXAMPLE 1

Several samples of detonating cord have been produced in accordance with the present invention as follows. Six lengths of cotton cord were employed. Three of the cords were "large" cords, having a nominal diameter of about 0.093 inches and comprising 18 strands. The other three cords were "small" cords having a nominal diameter of 0.048 inches and comprising six strands.

A PETN solution was prepared by dissolving 196 grams of PETN in 392.5 grams of acetone at 115° F. Each cord was soaked in the resulting PETN solution for 3 minutes at 53.3° C. (128° F.), and was then immersed in a cold water bath at 9.8° C. (41° F.) for a period of two minutes to rapidly precipitate particles of PETN within the interstices of the strings. The resultant PETN-impregnated cords were then dried for 2 hours at 95° C. (203° F.) to remove residual acetone and water. As a result of this treatment, the three large cords had an average PETN loading of about 2.1 grams per meter (9.8 grains per foot) of cord length, and the three small cords had an average PETN loading of 1.2 grams per meter (5.5 grains per foot) of cord length.

EXAMPLE 2

Two of the large cord samples of Example 1 were tested for their ability to detonate; one was wrapped with a single layer of Scotch Brand cellophane tape before testing to provide a confining jacket around the particle-impregnated cord, and the other was not. It was attempted to detonate the sample cords by priming them with a six gram booster (commercially available under the trademark SOB®) which was initiated with a standard No. 8 detonator. The cord end opposite the initiator was taped to a steel plate. The sample cord jacketed with cellophane tape was detonated, but the sample cord comprising the unwrapped cord did not detonate. A small cord sample that was jacketed with cellophane tape as described above was also detonated using the above-described technique. It is believed that the cellophane tape jacket enhanced the ability of the cords to detonate by confining within the cord the detonation reaction of the PETN particles.

The inability of the detonating cord samples of the present invention to detonate until they had been jacketed, as by the application of cellophane tape, is an advantageous safety feature inasmuch as it eliminates the possibility of an accidental detonation of the detonating cord during manufacture and prior to jacketing of the cord within a suitable jacket or enclosure.

Figure 1:
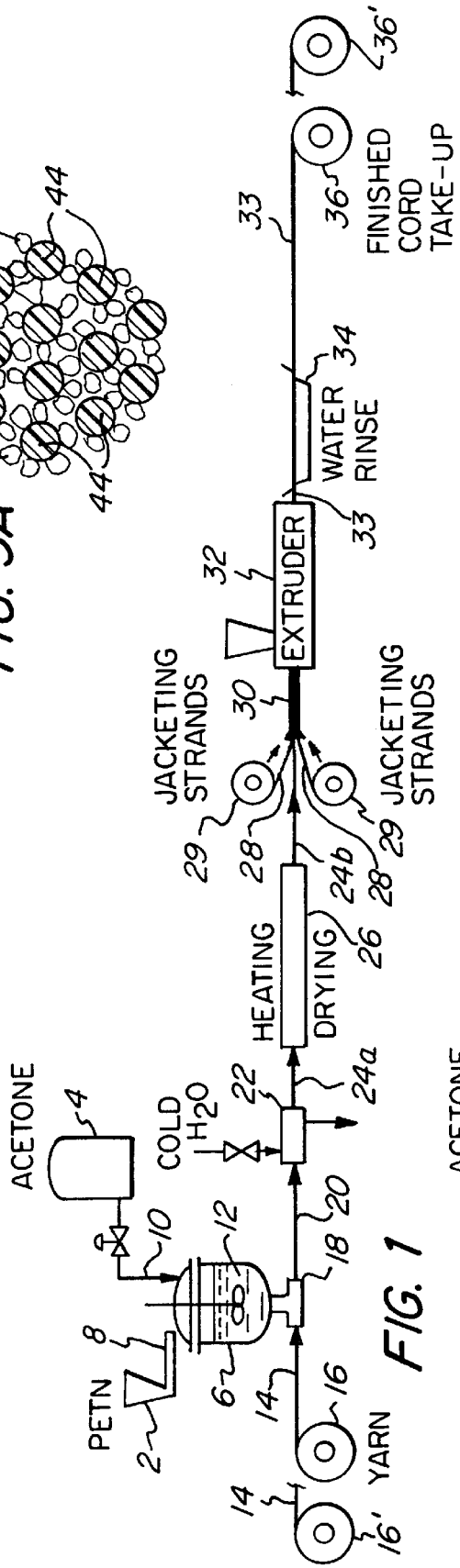
FIG. 1 is a schematic representation of a production line for manufacturing an explosive article in accordance with one embodiment of the present invention.

Referring to FIG. 1, there is shown a schematic illustration of a production line for manufacturing explosive articles of this invention. A water-insoluble explosive, e.g., PETN, is introduced from a supply hopper 2 and an organic solvent, e.g., acetone, is introduced from a supply tank 4 into a heated mixing tank 6 via feed lines 8 and 10, respectively, to form a solution 12 of the explosive in the solvent within mixing tank 6, from which the solution is fed to a solution bath station 18. An absorbent carrier material, e.g., cotton (or wool, linen, nylon, polyester or other suitable synthetic or natural fiber or fiber blend) yarn 14, is drawn from a supply roll 16 and is passed through solution bath station 18 to impregnate the yarn 14 with solution 12, producing a solution-impregnated carrier material 20. The carrier material 20 may comprise a strand material such as yarn 14 or may comprise a web of material to provide a sheet-like explosive carrier material or explosive article. The carrier material is absorbent to the extent that the solution can impregnate the carrier material and be retained therein for the purpose described below. A sheet-like explosive carrier material may be rendered into any suitable configuration of an explosive article such as sheets, rolls or batting, and may be cut into desired configurations such as disks, squares, rectangles, etc. The explosive carrier material may be combined with other materials, encased within them, alternated in layers, etc., to provide any desired configuration of finished product.

The solution-impregnated carrier material 20 is passed through a precipitating means comprising in the embodiment of FIG. 1, a cold, e.g., about 0.5° C. to 20° C. (32.9° F. to 68° F.), water bath station 22. The insolubility of the explosive in the non-solvent, i.e., the water, causes dissolved explosive material to rapidly precipitate from solution within the carrier material, yielding a wet explosive particle-containing carrier material 24*a*. The wet explosive particle-containing carrier material 24*a* is passed through a drying station 26 where water and any remaining solvent are driven from the carrier material and yield a dry, explosive particle-containing carrier material 24*b*. Jacketing strands, e.g., nylon threads 28, are drawn from strand supply rolls 29 and are woven around the explosive particle-containing carrier material 24*b* to yield a reinforced wrapped material 30 having increased tensile strength as compared to explosive particle-containing carrier material 24*b*. The reinforced wrapped material 30 is then passed through an extruder 32 where a polymeric jacket comprising, e.g., high density polyethylene, is applied thereto to provide a fully jacketed finished material 33. The jacketing provides confinement of the explosive, enhanced tensile strength and protection against mechanical forces and environmental damage such as impregnation by water, oil or other liquids. An optional water rinse tank 34 may be employed to cool and set the extruded jacket material or air-cooling may be used. The finished explosive material 33 is then collected on take-up roll 36.

It will be appreciated that the process as illustrated in FIG. 1 is capable of continuous operation for protracted periods of time. The period of continuous operation may be extended by providing a second supply roll 16' of yarn 14 (or of web material, etc.) so that, as the first supply roll 16 is exhausted, the yam 14 may be supplied from the second supply roll 16' without interruption of the process. When the second supply roll 16' is exhausted, the yarn may be supplied from a replenished first supply roll 16 without interruption of the process. The same technique may be used for the supply ofjacketing strands 28. Similarly, the supply of acetone and PETN to mixing tank 6 may be continuously replenished, and as take-up roll 36 is filled the finished explosive material 33 may be diverted to a second take-up roll 36' and thereafter to additional take-up rolls (not shown). Flying splices and other well-known techniques may be employed to assure smooth, continuous operation despite changing of rolls 16, 16', 24, 36 and 36'.

FIG. 1 illustrates one method of precipitation of explosive particles within the interstices of the carrier material, by contacting the solution-impregnated carrier material with a non-solvent fluid for the explosive, i.e., a vapor or a liquid in which the explosive is not soluble, e.g., steam or water in liquid form, thereby causing precipitation of the explosive as fine particles. The preferred and most commonly employed non-solvent is (liquid) water, preferably below room temperature.

Figure 2:
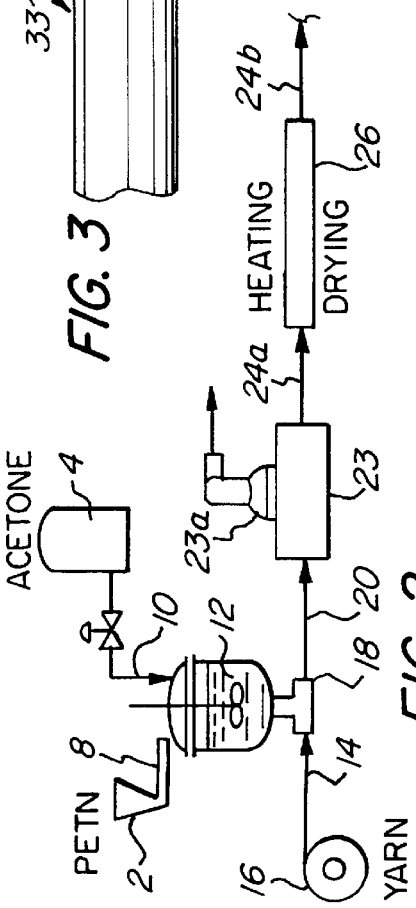
FIG. 2 is a schematic partial representation of a production line for manufacturing an explosive article in accordance with a second embodiment of the present invention.

Alternatively, precipitation may be attained by evaporating the solvent from the solution-impregnated carrier material. In order to facilitate a rapid rate of precipitation and thereby the production of finer precipitate particles, heat and/or vacuum may be employed to accelerate evaporation of the solvent from the solution-impregnated material, i.e., to employ flash evaporation. In such arrangement, the water bath station 22 may be replaced, as illustrated in FIG. 2, by a vacuum chamber 23 having a vacuum pump 23*a* connected thereto to exhaust vacuum chamber 23. Vacuum chamber 23 may be heated to further increase the rate of solvent evaporation. The rest of the production line, schematically illustrated in the partial view of FIG. 2, may be identical to the line of FIG. 1 and the parts shown in FIG. 2 are identically numbered to the corresponding parts shown in FIG. 1 and are not further described.

Whether the solvent is displaced from the solution-impregnated carrier material by displacement by a non-solvent fluid or evaporation or both, the solvent may readily be recovered for reuse in the process.

While any suitable explosive may be employed, the process of the invention is particularly well-suited for the production of explosive articles and the like comprised of secondary explosives which require, for their initiation, the detonation of a primary explosive such as lead azide, lead styphanate, or the like.

Explosive articles in accordance with the present invention as described above generally comprise a carrier material having the explosive material dispersed as fine particles throughout the interstices of the carrier material rather than merely at the surfaces thereof. The articles can therefore be produced without an extruded central core of explosive material as is the case with conventional detonating cord and the like. In addition, explosive articles produced in accordance with the present invention can easily be produced in a variety of configurations, e.g., ribbons, cords, discs, etc., for which the provision of a solid core of explosive material would be impractical. Special shapes may be readily cut, rolled or otherwise formed from a flat web of explosive-impregnated carrier material.

Figure 3:
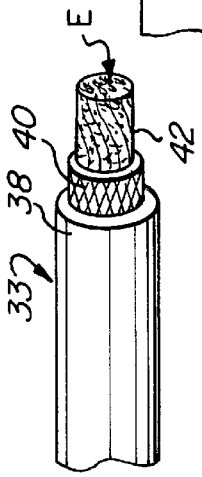
FIG. 3 is a schematic representation, with parts broken away, of a segment of detonating cord produced in accordance with the process illustrated in FIG. 1.

FIG. 3 shows a segment of the fully jacketed material 33 obtained from the process of FIG. 1 and comprising a detonating cord having an over-extruded plastic cover 38 (applied by extruder 32 of FIG. 1) overlying a woven jacket 40 comprised ofjacketing strands 28 of FIG. 1 and encasing a core 42 of the explosive particle-containing carrier material 24*b* of FIG. 1. FIG. 3A shows an enlarged view of that end of core 42 indicated by the arrow E in FIG. 3. Individual strands or fibers 44 of core 42 are seen in FIG. 3A to serve as sites for precipitation of fine crystals of explosive particles 46 dispersed throughout the interstices between the fibers of core 42. It is believed that individual fibers serve as nucleation sites for the precipitation of the explosive particles from the solution and once initial particles are formed they themselves serve as precipitation sites for additional crystallization.

Figure 4:
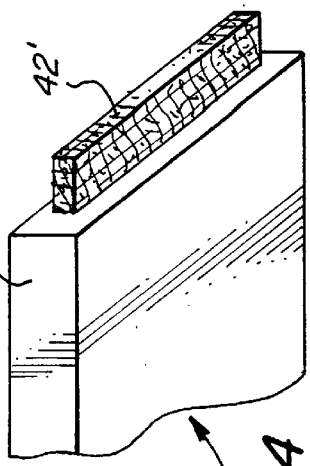
FIG. 4 is a view corresponding to FIG. 3 of another embodiment of an explosive article in accordance with the present invention.

FIG. 4 shows a finished explosive material 33' in accordance with another embodiment of the present invention wherein the core 42' of explosive particle-containing carrier material 24*b* is encased within a plastic cover 38'. In this embodiment, the core 42' is of ribbon shape, i.e., comprises a thin, flat web of generally rectangular cross sectional configuration, and is encased within a similarly shaped plastic cover 38'. In both the embodiments of FIGS. 3 and 4, the plastic cover 38 or 38', the woven jacket 40 of the FIG. 3 embodiment, and the cores 42, 42' may include reinforcing fibers therein for added mechanical strength.

While the invention has been described in detail with reference to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. A method of manufacturing an explosive carrier material comprising:

(a) dissolving an explosive in a solvent to provide a solution;

(b) impregnating an absorbent carrier material with the solution to provide a solution-impregnated carrier material; and (c) precipitating explosive particles within the solution-impregnated carrier material from the solution contained therewithin to yield an explosive particle containing carrier material.

2. The method of claim 1 comprising precipitating the explosive particles rapidly enough to form the explosive particles with a size distribution of at least about 99 percent by number of the particles having a diameter not greater than about 44 microns, and at least about 50 percent by number of the particles having a diameter not greater than about 5 microns.

3. The method of claim 1 or claim 2 wherein precipitating the explosive particles comprises introducing a non-solvent fluid into the solution-impregnated carrier material.

4. The method of claim 3 wherein the non-solvent fluid comprises steam.

5. The method of claim 3 wherein the non-solvent fluid comprises water in liquid form.

6. The method of claim 1 or claim 2 wherein precipitating the explosive particles comprises flooding the solution-impregnated carrier material with a non-solvent liquid.

7. The method of claim 6 wherein the solution comprises a solution of a nitrated organic explosive in a solvent selected from the group consisting of acetone and cyclohexanone, and the non-solvent liquid comprises water.

8. The method of claim 7 wherein the nitrated organic explosive is selected from the group consisting of PETN, RDX and HMX and the solvent comprises acetone.

9. The method of claim 1 or claim 2 comprising precipitating the explosive particles by evaporating the solvent from the solution-impregnated carrier material.

10. The method of claim 9 comprising evaporating the solvent by subjecting the solution-impregnated carrier material to a vacuum.

11. The method of claim 10 including heating the solution-impregnated carrier material and subjecting the heated carrier material to the vacuum.

12. The method of claim 1 or claim 2 including applying a jacket about the explosive particle-impregnated carrier material.

13. An explosive-containing article comprising an absorbent carrier material having particles of explosive material dispersed therethrough and obtained by impregnating the carrier material with a solution of an explosive dissolved in a solvent to provide a solution-impregnated carrier material and precipitating explosive particles within the impregnated carrier material from the solution contained therein.

14. The explosive-containing article of claim 13 further comprising ajacket encasing the carrier material.

15. The explosive-containing article of claim 13 or claim 14 wherein at least 99 percent by number of the particles of the explosive material have a diameter of not more than 44 microns and at least 50 percent by number of the particles of the explosive have a diameter not greater than about 5 microns.

16. The explosive-containing article of claim 13 or claim 14 wherein precipitating the explosive particles is carried out by introducing a non-solvent fluid into the solution-impregnated carrier material.

17. The explosive-containing article of claim 16 wherein the non-solvent fluid is a liquid.

18. The explosive-containing article of claim 17 wherein the liquid is water.

19. The explosive-containing article of claim 13 or claim 14 wherein precipitating the explosive particles is carried out by evaporating solvent from the solution-impregnated carrier material under a vacuum.

20. The explosive-containing article of claim 13 or claim 14 wherein the explosive is selected from the group consisting of PETN, RDX and HMX.

21. The method of claim 1 comprising precipitating the explosive particles by removing at least some of the solvent from the solution-impregnated carrier material.

* * * * *

UNITED STATES PATENT AND TRADEMARK OFFICE

CERTIFICATE OF CORRECTION

PATENT NO. : 5,939,661
DATED : August 17, 1999
INVENTOR(S) : James Bayliss

It is certified that error appears in the above-identified patent and that said Letters Patent is hereby corrected as shown below:

In column 1, line 18, replace "yam" with --yarn--;
line 34, replace "ajacket" with --a jacket--.
In column 3, line 2, replace "articles" with --particles--;
line 5, replace "han" with --than--;
line 24, replace "particle" with --article--.
In column 7, line 16, replace "yam" with --yarn--;
line 21, replace "ofjacketing" with --of jacketing--.
In column 8, line 16, replace "ofjacketing" with --of jacketing--.
In column 10, line 4, in claim 14, replace "ajacket" with --a jacket--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*